US011343635B2

(12) United States Patent
Laitinen

(10) Patent No.: US 11,343,635 B2
(45) Date of Patent: May 24, 2022

(54) STEREO AUDIO

(71) Applicant: NOKIA TECHNOLOGIES OY, Espoo (FI)

(72) Inventor: Mikko-Ville Laitinen, Espoo (FI)

(73) Assignee: NOKIA TECHNOLOGIES OY, Espoo (FI)

( * ) Notice: Subject to any disclaimer, the term of this patent is extended or adjusted under 35 U.S.C. 154(b) by 0 days.

(21) Appl. No.: 16/916,322

(22) Filed: Jun. 30, 2020

(65) Prior Publication Data

US 2021/0006928 A1 Jan. 7, 2021

(30) Foreign Application Priority Data

Jul. 5, 2019 (GB) ..... 1909715

(51) Int. Cl.
*H04S 7/00* (2006.01)
*H04S 1/00* (2006.01)

(52) U.S. Cl.
CPC ..... *H04S 7/304* (2013.01)

(58) Field of Classification Search
None
See application file for complete search history.

(56) References Cited

U.S. PATENT DOCUMENTS 4,837,824 A 6/1989 Orban
5,872,851 A * 2/1999 Petroff ..... H04S 3/00 381/18
8,175,303 B2 * 5/2012 Sawashi ..... H04S 7/302 381/302
2007/0025559 A1 * 2/2007 Mihelich ..... H04S 7/301 381/59
2009/0060207 A1 * 3/2009 Barry ..... H04R 5/04 381/17
2009/0161883 A1 * 6/2009 Katsianos ..... H04S 7/00 381/57
2010/0054498 A1 * 3/2010 Sollenberger ..... H03G 3/3026 381/104
2011/0158413 A1 * 6/2011 Goldfarb ..... H04H 60/04 381/1

(Continued)

FOREIGN PATENT DOCUMENTS

CN 108834037 A 11/2018
EP 2977984 A1 1/2016

(Continued)

OTHER PUBLICATIONS

Extended European Search Report for European Application No. 20182429.9 dated Nov. 5, 2020, 8 pages.

(Continued)

*Primary Examiner* — Qin Zhu
(74) *Attorney, Agent, or Firm* — Alston & Bird LLP

(57) ABSTRACT

An apparatus is provided that includes at least one processor and at least one memory including computer program code with the at least one memory and the computer program code configured to, with the at least one processor, cause the apparatus at least to analyze a level difference between a left channel and a right channel of a stereo audio signal and to determine if the level difference between the left channel and the right channel is above a threshold. The apparatus is also caused to conditionally, if the determined level difference is above the threshold, move signal energy from a louder one of the left channel and the right channel to the other of the left channel and the right channel to create a processed left channel and a processed right channel of a processed stereo audio signal. A corresponding method is also provided.

20 Claims, 3 Drawing Sheets

(56) References Cited

U.S. PATENT DOCUMENTS

| | | | | |
|---|---|---|---|---|
| 2012/0014485 | A1* | 1/2012 | Kimura | H04S 7/30 375/345 |
| 2014/0341388 | A1* | 11/2014 | Goldstein | G10K 11/17854 381/71.11 |
| 2017/0188168 | A1 | 6/2017 | Lyren et al. | |
| 2017/0188169 | A1 | 6/2017 | Chon et al. | |
| 2018/0048277 | A1 | 2/2018 | Xu | |
| 2019/0098427 | A1 | 3/2019 | Gomez-Bolanos et al. | |
| 2021/0274301 | A1 | 9/2021 | Peng et al. | |

FOREIGN PATENT DOCUMENTS

| | | | |
|---|---|---|---|
| JP | S57 60800 | A | 4/1982 |
| JP | 2943713 | B2 | 8/1999 |
| JP | 2006135489 | | 5/2006 |
| JP | 2014072724 | A1 | 4/2014 |
| WO | WO 2009/125046 | A1 | 10/2009 |

OTHER PUBLICATIONS

Francart, T., *Perception of Binaural Localization Cues With Combined Electric and Acoustic Hearing*, Thesis, Katholieke Universiteit Leuven (Nov. 2008) 245 pages.

Gardner, W. G., *3-D Audio Using Loudspeakers*, Research Paper, Massachusetts Institute of Technology (Sep. 1997) 153 pages.

Search Report for United Kingdom Application No. GB1909715.3 dated Dec. 23, 2019, 1 page.

Office Action for European Application No. 20182429.9 dated Mar. 15, 2022, 5 pages.

* cited by examiner

STEREO AUDIO

CROSS-REFERENCE TO RELATED APPLICATIONS

This application claims priority to Great Britain Application No. 1909715.3, filed Jul. 5, 2019, the entire contents of which are incorporated herein by reference.

TECHNOLOGICAL FIELD

Embodiments of the present disclosure relate to stereo audio. Some relate to stereo audio render via headphones.

BACKGROUND

A stereo audio signal comprises a left channel and a right channel. The left channel of the stereo audio signal is rendered to a left audio output device. The right channel of the stereo audio signal is rendered to a right audio output device.

BRIEF SUMMARY

According to various, but not necessarily all, embodiments there is provided an apparatus comprising means for:

analyzing a level difference between a left channel and a right channel of a stereo audio signal;

determining if the level difference between the left channel and the right channel is above a threshold;

conditionally, if the determined level difference is above the threshold, moving signal energy from a louder one of the left channel and the right channel to the other of the left channel and the right channel to create a processed left channel and a processed right channel of a processed stereo audio signal.

In some but not necessarily all examples, the apparatus comprises means for smoothing the level difference over time before determining if the level difference between the left channel and the right channel is above a threshold.

In some but not necessarily all examples, the apparatus comprises means for conditionally, if the level difference is above the threshold for a first one of a plurality of frequency bands, moving signal energy for that first frequency band from the louder one of the left channel and the right channel to the other of the left channel and the right channel to create the processed left channel and the processed right channel of the processed stereo audio signal.

In some but not necessarily all examples, the apparatus comprises:

means for moving first signal energy for a first frequency band from the louder one of the left channel and the right channel for the first frequency band to the other of the left channel and the right channel for the first frequency band, if the level difference is above the threshold for the first frequency band, and means for moving second signal energy for a second frequency band from the louder one of the left channel and the right channel for the second frequency band to the other of the left channel and the right channel for the second frequency band, if the level difference is above the threshold for the second frequency band, wherein moving first signal energy and moving second signal energy creates the processed left channel and the processed right channel of the processed stereo audio signal.

In some but not necessarily all examples, the apparatus comprises means for smoothing over time movement of signal energy from the louder one of the left channel and the right channel to the other of the left channel and the right channel.

In some but not necessarily all examples, the apparatus comprises means for re-scaling a signal energy level of the louder one of the left channel and the right channel after moving signal energy from the louder one of the left channel and the right channel to the other of the left channel and the right channel In some but not necessarily all examples, a first gain is used to re-scale a signal energy level of the louder one of the left channel and the right channel after moving signal energy from the louder one of the left channel and the right channel to the other of the left channel and the right channel and a second gain is used to define the signal energy moved from the louder one of the left channel and the right channel to the other of the left channel and the right channel, wherein the second gain used for a current time frame is based on a weighted summation of a putative second gain for the current time frame and at least a used second gain for a preceding time frame, wherein weightings of the summation are adaptable in dependence upon a putative impact of the putative second gain for the current time frame on the level difference between the processed left channel and the processed right channel.

In some but not necessarily all examples, the weightings of the summation are biased to decrease the level difference between the processed left channel and the processed right channel more quickly than increase the level difference between the processed left channel and the processed right channel.

In some but not necessarily all examples, moving signal energy from a louder one of the left channel and the right channel to the other of the left channel and the right channel is controlled in dependence upon a function that is dependent upon the determined level difference, wherein when the determined level difference is above the threshold, then the target level difference is less than the determined level difference and wherein the function is adaptable by a user and/or wherein the target level difference has a maximum value at least when the determined level difference exceeds a saturation value.

In some but not necessarily all examples, the apparatus comprises means for conditionally, if the level difference is not above the threshold, not moving signal energy from a louder one of the left channel and the right channel to the other of the left channel and the right channel to create a processed left channel and a processed right channel of a processed stereo audio signal.

In some but not necessarily all examples, the apparatus comprises means for conditionally, if the level difference is not above the threshold for a frequency band, bypassing moving signal energy for that frequency band from a louder one of the left channel and the right channel to the other of the left channel and the right channel to create a processed left channel and a processed right channel of a processed stereo audio signal.

In some but not necessarily all examples, the apparatus is configured as headphones comprising a left-ear audio output device and a right-ear audio output device and comprising means for rendering the processed left channel from the left-ear audio output device and the processed right channel from the right-ear audio output device.

In some but not necessarily all examples, a system comprises the apparatus and headphones comprising a left-ear audio output device for rendering the processed left channel and a right-ear audio output device for rendering the processed right channel.

According to various, but not necessarily all, embodiments there is provided a computer program that when run by a processor causes:

analyzing a level difference between a left channel and a right channel of a stereo audio signal;

determining if the level difference between the left channel and the right channel is above a threshold;

conditionally, if the determined level difference is above the threshold, moving signal energy from a louder one of the left channel and the right channel to the other of the left channel and the right channel to create a processed left channel and a processed right channel of a processed stereo audio signal.

In some but not necessarily all examples, the computer program is configured as an application program for user selection of audio for playback to the user.

According to various, but not necessarily all, embodiments there is provided a method comprising:

Analyzing a level difference between a left channel and a right channel of a stereo audio signal;

determining if the level difference between the left channel and the right channel is above a threshold; and conditionally, if the determined level difference is above the threshold, moving signal energy from a louder one of the left channel and the right channel to the other of the left channel and the right channel to create a processed left channel and a processed right channel of a processed stereo audio signal.

According to various, but not necessarily all, embodiments there is provided examples as claimed in the appended claims.

BRIEF DESCRIPTION

Some example embodiments will now be described with reference to the accompanying drawings in which.

DETAILED DESCRIPTION

Figure 1:
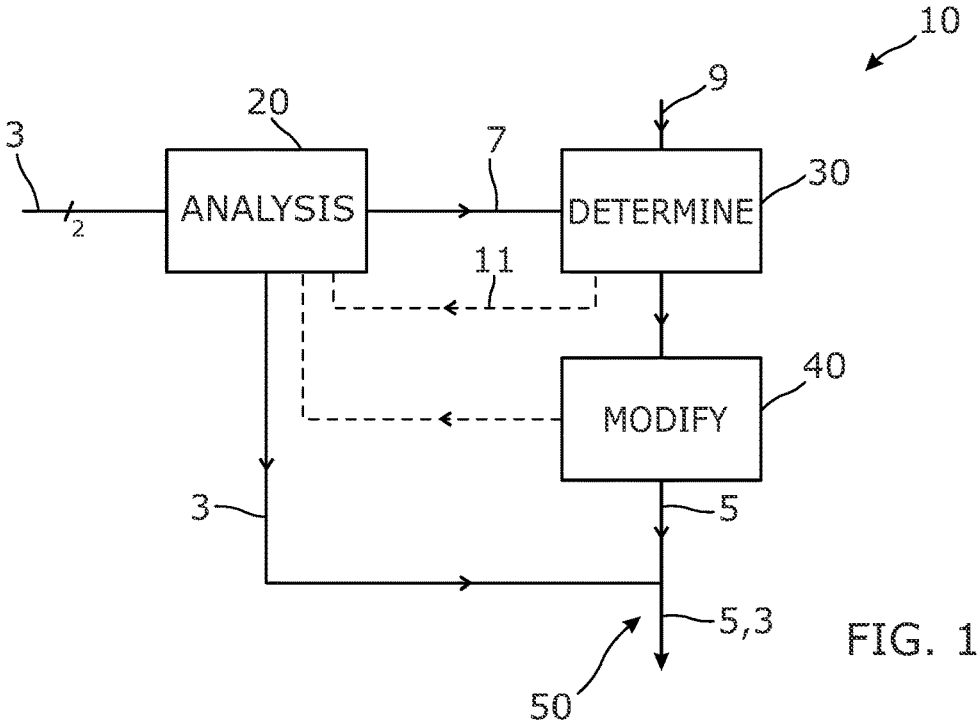
FIG. 1 shows an example embodiment of the subject matter described herein.

A stereo audio signal comprises a left channel and a right channel. The left channel of the stereo audio signal is rendered to a left audio output device. The right channel of the stereo audio signal is rendered to a right audio output device.

In some examples, the left audio output device is a left headphone for positioning at or in a user's left ear and the right audio output device is a right headphone for positioning at or in a user's right ear. In some examples, the left and right headphones are provided as in-ear buds. In some examples, the left and right headphones are positioned at a user's ears by a supporting headset.

In some examples, the left audio output device is a loudspeaker for positioning at least partially to the left of a user's position and the right audio output device is a loudspeaker for positioning at least partially to the right of a user's position. The left and right loudspeakers are often positioned in front of and the respective left and right of the intended user position.

Stereo audio signals have been distributed for stereo music and other audio content from the 1960s. Before that the music and audio was distributed as a mono audio signal (a single channel signal). Up until the 1980s rendering (reproducing) of music was normally via stereo loudspeakers. In the 1980s headphones become more popular.

In the early days of stereo music (i.e., in the 60s and 70s), as the music was rendered only with loudspeakers it was customary to produce the stereo mixes as relatively "extreme", e.g., by positioning one instrument to extreme left and another different instrument to extreme right. This highlighted the effect of stereo rendering in contrast to mono rendering. Later, less "extreme" positioning was used, and both loudspeakers rendered all instruments at least to some degree, however, instruments could be positioned by rendering the instruments at different levels in different channels. The term level can be indicative of amplitude or indicative of energy or indicative of intensity or indicative of loudness. The energy can be estimated as the square of the amplitude.

Teleconferencing systems may also position different participants to extreme directions, in order to enable maximal sound source spacing. While such stereo signals may be good for loudspeaker listening in the case of teleconferencing, they may not be optimal for headphone listening.

At least some of the examples described below conditionally modify a user's listening experience by reducing level differences between the stereo channels when a condition is satisfied. As a result, stereo audio is modified to avoid excessive positioning (e.g., hard-panning or extreme-panning) but is not modified if the stereo audio does not have excessive positioning.

The adaptive processing mitigates excessive level differences between channels of stereo audio signals when needed. Stereo audio content that is lacking extreme positioning is not modified. As a result, the method can be enabled for all music and audio, and it improves listening experience with some signals without harming it with others.

In at least some examples, a user can provide inputs that control the user's listening experience. The user can, in some examples, control at least partially the condition for reducing level differences between the stereo channels. The user can, in some examples, control at least partially the processing used to reduce level differences between the stereo channels. This can, for example, modify one or more of: granularity of processing, the amount of reduction of level differences, smoothing of changes to level difference.

The processing to obtain reduced level differences between the stereo channels does not create a mono channel, the channels remain different stereo channels. The left channel and the right channel are different after a reduction in level difference. Spatial audio cues with the stereo audio are, at least partially, retained.

The FIGs illustrate examples of an apparatus 10 comprising means 20, 30, 40 for:

(i) analyzing 120 level differences 7 between a left channel and a right channel of a stereo audio signal 3;

(ii) determining 130 if a level difference 7 between the left channel and the right channel is above a threshold 9;

(iii) conditionally, if the level difference 7 is above the threshold 9, moving 140 signal energy from a louder one of the left channel and the right channel to the other of the left channel and the right channel to create a processed left channel and a processed right channel of a processed stereo audio signal 5; and (iv) output 150 the processed stereo audio signal 5.

The louder one of the left channel and the right channel is the channel with the higher level. Moving the signal energy changes that level and reduces the level difference between the left and right channels The processing of level differences may, for example, take place in broadband or in multiple frequency bands. In at least some examples, the apparatus comprises means for (iii) conditionally, if the level difference 7 is above the threshold 9 for one or more frequency bands of a plurality of frequency bands, moving signal energy 140 for the one or more frequency bands from the louder of the left channel and the right channel to the other of the left channel and the right channel to create the processed left channel and the processed right channel of the processed stereo audio signal.

The level differences between a left channel and a right channel of a stereo audio signal can, for a broadband single band example be a single level difference determined at different times.

The level differences between a left channel and a right channel of a stereo audio signal can, for a multi-frequency band example be multiple level differences determined at different frequencies and different times.

Each of the functions (i), (ii), (iii), (iv) (and other functions described below) can be performed automatically or semi-automatically. The term automatically means that the function is performed without any need for user input at the time of the performance of the function. In some circumstances the user may need to have performed a set-up procedure in advance to set parameters that are re-used for subsequent automatic performances of the function. If a function is performed automatically, in some circumstances it can be performed transparently with respect to the user at the time of its performance. That is no indication is provided to the user at the time of performing the function that the function is being performed. The term semi-automatically means that the function is performed but only after user input at the time of the performance of the function. The user input can, for example, be a confirmatory input or other input.

Therefore in at least some examples the apparatus is configured to automatically reduce level differences between stereo channels. In some example, this can be transparent to the user.

Therefore in at least some examples the apparatus is configured to semi-automatically reduce level differences between stereo channels.

FIG. 1 illustrates an example of an apparatus 10 comprising:

(i) analysis means 20 for analyzing a level difference 7 between a left channel and a right channel of a stereo audio signal 3;

(ii) determining means 30 for determining if the level difference 7 between the left channel and the right channel is above a threshold 9;

(iii) modifying means 40 for conditionally moving signal energy from a louder one of the left channel and the right channel to the other of the left channel and the right channel to create a processed left channel and a processed right channel of a processed stereo audio signal 5, if the level difference 7 is above the threshold 9; and (iv) output means 50 for outputting the processed stereo audio signal 5.

If the level difference 7 is not above the threshold 9, the determining means 30 provides a control signal 11 that causes means 50 to output the original stereo audio signal 3. In the example illustrated, a control signal 11 is provided by determining means 30 to the analysis means 20, which provides the original stereo audio signal 3 to the output means 50.

One or more or all of the analysis means 20, determining means 30, modifying means 40 and output means 50 can be provided as circuitry.

One or more or all of the analysis means 20, determining means 30, modifying means 40 and output means 50 can be provided as computer program code executed by circuitry.

Figure 2:
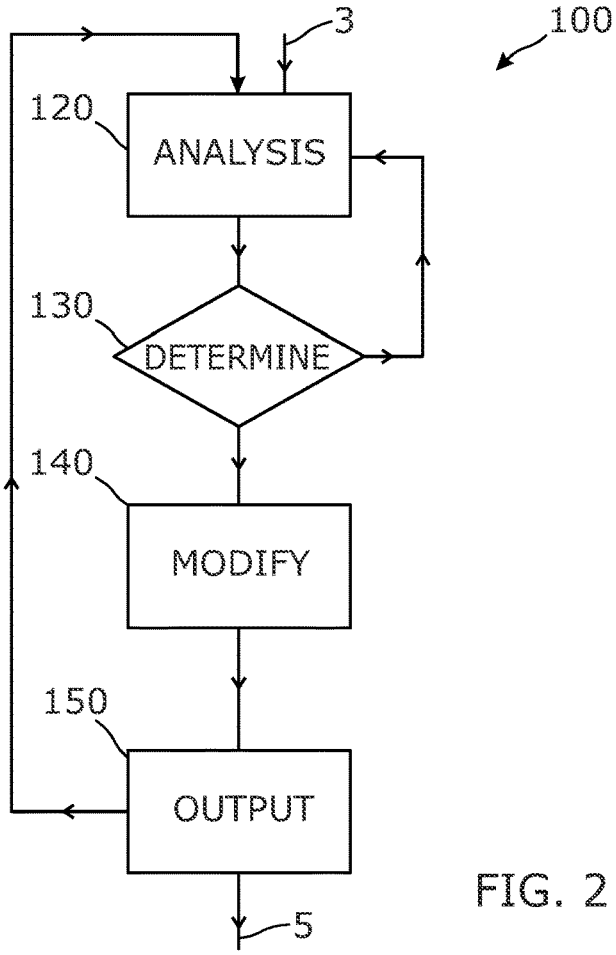
FIG. 2 shows another example embodiment of the subject matter described herein.

FIG. 2 illustrates an example of a method 100 comprising:

(i) at block 120 analyzing a level difference 7 between a left channel and a right channel of a stereo audio signal 3;

(ii) at block 130 determining if the level difference 7 between the left channel and the right channel is above a threshold 9;

(iii) at block 140 conditionally, if the level difference 7 is above the threshold 9, moving signal energy from a louder one of the left channel and the right channel to the other of the left channel and the right channel to create a processed left channel and a processed right channel of a processed stereo audio signal 5; and (iv) at block 150 outputting the processed stereo audio signal 5.

The method 100 is conditional. If the level difference 7 is above the threshold 9, the method 100 moves from block 130 to 140 else the method 100 returns to block 120.

The method 100 is iterative. The method 100 is repeated for each contiguous time segment of the stereo audio signal 3. In the example illustrated, but not necessarily all examples, the method 100 repeats when the processed stereo audio signal 5 is output. However, it will be appreciated that processing of the next segment can, in some circumstances, occur sequentially but earlier or occur in parallel.

One or more or all of the blocks 120, 130, 140, 150 can be performed by circuitry. One or more or all of the blocks 120, 130, 140, 150 can be caused to be performed by computer program code when executed by circuitry.

Figure 3:
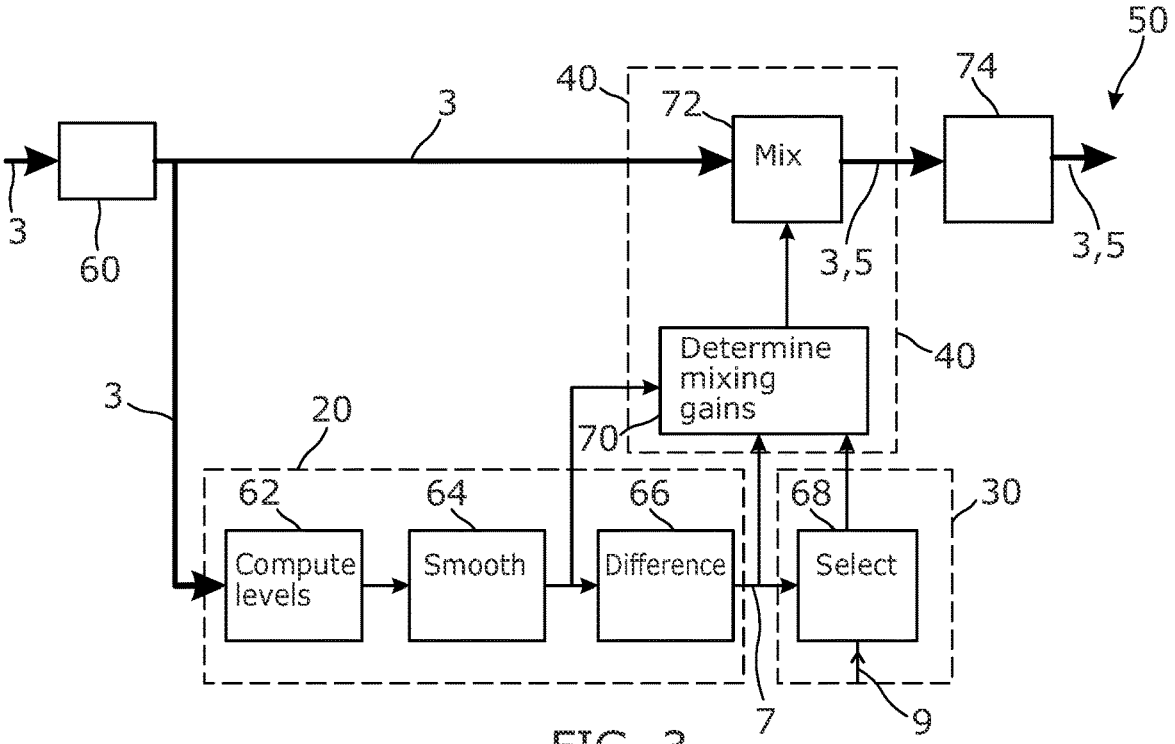
FIG. 3 shows another example embodiment of the subject matter described herein.

FIG. 3 illustrates another example of an apparatus 10, for example as illustrated in FIG. 1.

The apparatus 10 comprises:

(i) analysis means 20 for analyzing a level difference 7 between a left channel and a right channel of a stereo audio signal 3;

(ii) determining means 30 for determining if the level difference 7 between the left channel and the right channel is above a threshold 9;

(iii) modifying means 40 for conditionally moving signal energy from a louder one of the left channel and the right channel to the other of the left channel and the right channel to create a processed left channel and a processed right channel of a processed stereo audio signal 5, if the level difference 7 is above the threshold 9; and (iv) output means 50 for outputting the processed stereo audio signal 5.

A stereo audio signal 3 is input to the apparatus 10. The stereo signal 3 comprises a left channel and a right channel. In the following, the stereo audio signal 3 is represented using $s_i(t)$, where i is the channel index and t is time.

In this example but not necessarily all examples, a time to frequency domain transform 60 is used to transform the time-domain stereo signals $s_i(t)$ to time-frequency domain signals $S_i(b,n)$, where b is a frequency bin index and n is a temporal frame index. The transformation can be performed using any suitable transform, such as short-time Fourier transform (STFT) or complex-modulated quadrature mirror filter bank (QMF).

Next, at block 62, levels are determined for the different channel. A different level is determined for each channel, for each frequency band (k), for each consecutive contiguous time period n. In this example, the level is computed in terms of energy.

The frequency bands can be any suitable arrangement of bands. For example, between 20 and 40 bands may be used. In some but not necessarily all examples, the bands are Bark scale critical bands.

Energy is computed in frequency bands for each channel $$E_i(k,n)=\sum_{b=B_{low}(k)}^{B_{high}(k)}|S_i(b,n)|^2$$

where k is the frequency band index, $B_{low}(k)$ is the lowest bin of the frequency band k, and $B_{high}(k)$ is the highest bin of the frequency band k, and n is the time index.

In this example, but not necessarily all examples, at block 64 a different level is determined for each channel, for each frequency band (k), over an extended time period. The level (energy) estimates are smoothed over time, e.g., by $$E'_i(k,n)=a_1E_i(k,n)+b_1E'_i(k,n-1)$$

where $a_1$ and $b_1$ are smoothing coefficients (e.g., $a_1=0.1$ and $b_1=1-a_1$)

The smoothed energy level can be a weighted moving average of energy levels for recent time periods, where the weighting more heavily favors more recent time periods.

The louder and the softer of the two channels are determined. The louder channel has a greater level. The corresponding energies $E'_i(k,n)$ are set to the $\Xi$ variable, where $\Xi_1$ is the louder of the energies, and $\Xi_0$ the softer.

if $E'_0(k,n)<E'_1(k,n)$ $$\Xi_0(k,n)=E'_0(k,n),\Xi_1(k,n)=E'_1(k,n)$$

else $$\Xi_0(k,n)=E'_1(k,n),\Xi_1(k,n)=E'_0(k,n)$$

Next, at block 66, analysis determines level differences 7 between the left channel and the right channel of the stereo audio signal 3.

The level difference can, for example, be expressed as a quotient of louder to softer:

$$R(k,n)=10\log_{10}\frac{\Xi_1(k,n)}{\Xi_0(k,n)}$$

The level difference can, for example, be expressed as a subtraction:

$$R(k,n)=10\log_{10}\Xi_1(k,n)-10\log_{10}\Xi_0(k,n)$$

In these examples, the relative level measurement is in dB (for energy). If the level $\Xi_0(k,n)$ is expressed in amplitude, instead of energy, the multiplication factor would be 20 instead of 10.

The blocks 62, 64, 66 provide analysis means 20 for analyzing level differences 7 between the left channel and the right channel of the stereo audio signal 3. The level differences 7 between the left channel and the right channel are analyzed for each frequency band.

Next, at block 68, it is determined if the level difference 7 between the channels is above a threshold 9.

The threshold 9 can be selected to define excess level differences 7 between stereo channels that would be perceived as unpleasant when listening to with headphones. The threshold 9 can, in some but not necessarily all examples, be a user adjustable parameter.

For example, if R(k,n) is below a threshold X (e.g., 6 dB), the mixing mode is set to "passthrough" mode. Otherwise, the mixing mode is set to "mix" mode. The condition for selecting the mix mode or the passthrough mode is based on the threshold.

If it is determined to use the "mix" mode for signals $S_i(b,n)$, (i.e., R(k,n) is above the threshold), some energy should be moved from the louder channel to the softer channel. This creates a processed left channel and a processed right channel of a processed stereo audio signal 5.

If the level difference 7 is above the threshold 9 for a frequency band, the apparatus 10 moves signal energy for that frequency band (but not necessarily other frequency bands) from a louder one of the left channel and the right channel to the other of the left channel and the right channel to create a processed left channel and a processed right channel of a processed stereo audio signal 5.

If it is determined to use the passthrough mode for signals $S_i(b,n)$, (i.e., R(k,n) is not above the threshold), then stage of moving energy from the louder channel to the softer channel is bypassed.

If the level difference 7 is not above the threshold 9 for a frequency band, the apparatus 10 bypasses moving signal energy for that frequency band (but not necessarily other frequency bands) from a louder one of the left channel and the right channel to the other of the left channel and the right channel to create a processed left channel and a processed right channel of a processed stereo audio signal 5.

The block 68 provides determining means 30 for determining if a level difference 7 between the left channel and the right channel is above a threshold 9.

Next, at block 70, mixing gains are determined based on the determined mixing mode. First, initial gains $g_0(k,n)$ and $g_1(k,n)$ are computed.

Before reduction of the level difference:

the lower energy signal is $\Xi_0(k,n)$ the higher energy signal is $\Xi_1(k,n)$.

After reduction of the level difference:

the lower energy signal has become $\Xi_0(k,n)'=(g_0(k,n)^2\Xi_1(k,n)+\Xi_0(k,n))$ and the higher energy signal has become $\Xi_1(k,n)'=(g_1(k,n)^2\Xi_1(k,n))$ A first gain $g_0(k,n)^2$ is applied to the louder channel signal $\Xi_1(k,n)$ and the resulting signal $(g_0(k,n)^2\Xi_1(k,n)$ is moved to the softer channel $\Xi_0(k,n)$. The resulting processed softer channel signal $\Xi_0(k,n)'$ is the sum $(g_0(k,n)^2\Xi_1(k,n)+\Xi_0(k,n))$. A second gain $g_1(k,n)^2$ is applied to the louder channel signal $\Xi_1(k,n)$ to produce a resulting processed louder channel signal $\Xi_1(k,n)'$.

Gains are not applied to the softer channel signal $\Xi_0(k,n)$. Instead, a part of the louder channel signal $(g_0(k,n)^2\Xi_1(k,n)$ is moved to the softer signal $\Xi_0(k,n)$. The louder channel is attenuated by second gain $g_1(k,n)^2$ so that the total loudness is not affected.

This approach avoids amplifying the softer lower level signal at a low level signal $\Xi_0(k,n)$, which could make any noise audible. Also, the left and right channel signals may be incoherent. Hence, amplifying the softer signal would not actually move the perceived audio source towards center, but, instead, it could just amplify some other audio source. Moving a part of the signal from the louder channel to the softer channel is a better alternative as it does not amplify any signal, and it actually moves the perception of a sound source towards the center.

If mixing is in the "passthrough" mode, the gains can be determined simply by $$g_0(k,n)=0$$

$$g_1(k,n)=1$$

$$\Xi_1(k,n)'=(g_1(k,n)^2\Xi_1(k,n))=\Xi_1(k,n))$$

$$\Xi_0(k,n)'=(g_0(k,n)^2\Xi_1(k,n)+\Xi_0(k,n))=\Xi_0(k,n)$$

In this case, it is assumed that there is no excessive positioning, and no need to move energy from louder channel to softer channel.

If mixing is in the "mix" mode, the gains can be determined to move signal energy from a louder one of the left channel and the right channel to the other of the left channel and the right channel to create a processed left channel and a processed right channel of a processed stereo audio signal 5.

The level difference 7 between the stereo channels is reduced by moving signal energy from a louder one of the left channel and the right channel to the other of the left channel and the right channel. The level difference between the processed left channel and the processed right channel of the processed stereo audio signal 5 is less than the determined level difference between the left channel and the right channel of the original stereo audio signal 3.

Thus if the inter-channel level difference is above the threshold for a frequency band, signal energy for that frequency band (but not other frequency bands) is moved from a louder one of the left channel and the right channel to the other of the left channel and the right channel to create a processed left channel and a processed right channel of a processed stereo audio signal.

In some but not necessarily all examples, the derived gains for the mix mode can fulfil at least two criteria. First, energy is moved from the higher level channel to the lower level channel. Second the resulting audio signals (after the gains have been applied) should have the same total energy as the original signals.

Before reduction of the level difference: the lower energy signal is $\Xi_0(k,n)$ and the higher energy signal is $\Xi_1(k,n)$.

After reduction of the level difference: the lower energy signal has become $$\Xi_0(k,n)'=(g_0(k,n)^2\Xi_1(k,n)+\Xi_0(k,n)) \text{ and}$$

the higher energy signal has become $\Xi_1(k,n)'=(g_1(k,n)^2\Xi_1(k,n))$.

Then because the resulting audio signals (after the gains have been applied) should have the same total energy as the original signals, i.e., $$\Xi_0(k,n)+\Xi_1(k,n)=\Xi_0(k,n)'+\Xi_1(k,n)'$$

Then $$(g_0(k,n)^2\Xi_1(k,n)+\Xi_0(k,n))+(g_1(k,n)^2\Xi_1(k,n))=\Xi_0(k,n)+\Xi_1(k,n).$$

Let us define a target level difference T(k,n)'. The gains $g_0(k,n)$ and $g_1(k,n)$ can then be expressed in terms of $g_0(k,n)$, $g_1(k,n)$, $\Xi_0(k,n)$, $\Xi_1(k,n)$.

For example let T(k,n)' be the target ratio of levels after the gains have been applied, where the levels are measure as energy $$T(k,n)'=\frac{\Xi_1(k,n)'}{\Xi_0(k,n)'}$$

Therefore $$\frac{g_1(k,n)^2\Xi_1(k,n)}{g_0(k,n)^2\Xi_1(k,n)+\Xi_0(k,n)}=T'(k,n).$$

Substituting into the constant energy equation:

$$(g_0(k,n)^2\Xi_1(k,n)+\Xi_0(k,n))+(g_1(k,n)^2\Xi_1(k,n))=\Xi_0(k,n)+\Xi_1(k,n).$$

Results is the following gains:

$$g_0(k,n)=\sqrt{\frac{-T'(k,n)\Xi_0(k,n)+\Xi_1(k,n)}{(1+T'(k,n))\Xi_1(k,n)}}$$

$$g_1(k,n)=\sqrt{\frac{T'(k,n)\Xi_0(k,n)+T'(k,n)g_0^2(k,n)\Xi_1(k,n)}{\Xi_1(k,n)}}$$

The gain $g_0(k,n)$ relates to an estimated instantaneous need for moving energy from one channel to another. The gain $g_1(k,n)$ relates to a need for conservation of energy.

Let us define a target level difference T(k,n) (in dB)

$$T'(k,n)=10^{\frac{T(k,n)}{10}} \text{ or}$$

$$T(k,n)=10\log_{10}T(k,n)'$$

Let us define a function F that relates the actual level difference R to the target level difference i.e. T=F(R), where R≥X.

The target level difference T is then a function dependent upon the determined level difference (R). When the determined level difference (R) is above the threshold (X), then the target level difference is less than the determined level difference (R).

In some but not necessarily all examples, the target level difference T has a maximum value $T_{max}$ at least when the determined level difference (R) exceeds a saturation value $R_{sat}$.

In some but not necessarily all examples, the target level difference T is monotonically increasing between a minimum value Tmin and a maximum value Tmax.

In some but not necessarily all examples the function, at least when the determined level difference (R) is initially above the threshold (X), is a monotonically increasing function that has a gradient (dT/dR) that is less than 1.

In some but not necessarily all examples the function, at least when the determined level difference (R) is initially above the threshold (X), is a linearly increasing function that has a gradient (dT/dR) that is less than 1.

In some but not necessarily all examples the function is adaptable by a user. For example, the user could adapt one of more of X, $R_{sa}$, Tmin, Tmax, the gradient dT/dR.

Figure 4:
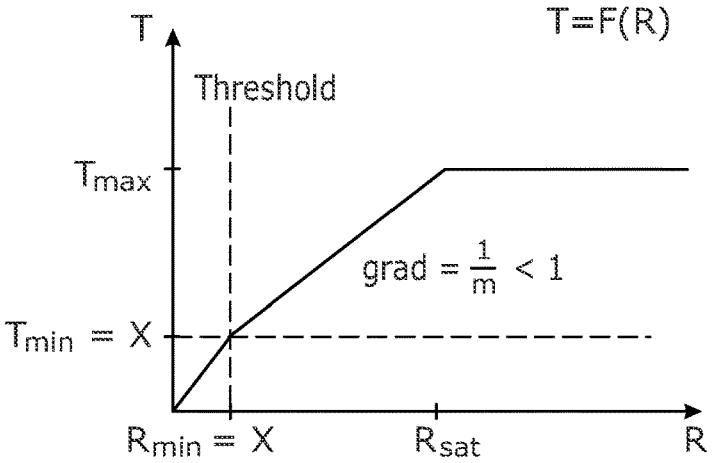
FIG. 4 shows another example embodiment of the subject matter described herein.

FIG. 4 illustrates an example of a function F, where T=F(R).

In this example:

$$T(k,n)=\frac{R(k,n)-X}{m}+T\min$$

where m>1, Tmin=X.

For R>X, T<R $$T(k,n)=\frac{R(k,n)-6}{2}+6,\text{ if } X\le R(k,n)<18$$

$$T(k,n)=12,\text{ if } R(k,n)\ge 18$$

Energy is moved from the louder channel to the quieter channel, and the louder channel is re-scaled using:

$$S'_0(k,n)=g_{l1}(k,n)S_0(k,n)+g_{r0}(k,n)S_1(k,n)$$

$$S'_1(k,n)=g_{r1}(k,n)S_1(k,n)+g_{l0}(k,n)S_0(k,n)$$

If $E'_0(k,n)<E'_1(k,n)$ $$g_{l0}(k,n)=0$$

$$g_{l1}(k,n)=1$$

$$g_{r0}(k,n)=g_0(k,n)$$

$$g_{r1}(k,n)=g_1(k,n)$$

and $$S'_0(k,n)=S_0(k,n)+g_0(k,n)S_1(k,n)$$

$$S'_1(k,n)=g_1(k,n)S_1(k,n)$$

Energy is moved from the louder channel to the quieter channel, and the louder channel is re-scaled. A first gain $g_1(k,n)$ is used to re-scale a signal level $S_1(k,n)$ of the louder channel to provide the processed channel $S'_1(k,n)$. A second gain $g_0(k,n)$ is used to define the signal energy moved from the louder channel $S_1(k,n)$ to the other processed channel $S'_0(k,n)$.

if $E'_0(k,n)>E'_1(k,n)$ $$g_{r0}(k,n)=0$$

$$g_{r1}(k,n)=1$$

$$g_{l0}(k,n)=g_0(k,n)$$

$$g_{l1}(k,n)=g_1(k,n)$$

and $$S'_0(k,n)=g_1S_0(k,n)$$

$$S'_1(k,n)=S_1(k,n)+g_0(k,n)S_0(k,n)$$

Energy is moved from the louder channel to the quieter channel, and the louder channel is re-scaled. A first gain $g_1(k,n)$ is used to re-scale a signal level $S_0(k,n)$ of the louder channel to provide the processed channel $S'_0(k,n)$. A second gain $g_0(k,n)$ is used to define the signal energy moved from the louder channel $S_0(k,n)$ to the other processed channel $S'_1(k,n)$.

In some but not necessarily all examples, the movement of signal energy between channels can be smoothed over time. For example, the first gain and the second gain can be smoothed over time.

In some but not necessarily all examples, the second gain $g_{r0}(k,n)$ used for a current time frame is based on a weighted summation of a putative second gain $g_0(k,n)$ for the current time frame and at least a used second gain $g_{r0}(k,n-1)$ for a (immediately) preceding time frame. The first gain $g_{r1}(k,n)$ used for a current time frame is based on a weighted summation of a putative first gain for the current time frame $g_1(k,n)$ and at least a used first gain $g_{r1}(k,n-1)$ for a (immediately) preceding time frame. For example, If $E'_0(k,n)<E'_1(k,n)$ $$g_{l0}(k,n)=0$$

$$g_{l1}(k,n)=1$$

$$g_{r0}(k,n)=a\ g_0(k,n)+b\ g_{r0}(k,n-1)$$

$$g_{r1}(k,n)=a\ g_1(k,n)+b\ g_{r1}(k,n-1)$$

if $E'_0(k,n)>E'_1(k,n)$ $$g_{r0}(k,n)=0$$

$$g_{r1}(k,n)=1$$

$$g_{l0}(k,n)=a\ g_0(k,n)+b\ g_{l0}(k,n-1)$$

$$g_{l1}(k,n)=a\ g_1(k,n)+b\ g_{l1}(k,n-1)$$

When $E'_0(k,n)>E'_1(k,n)$, the second gain for a current time frame is $g_{l1}(k,n)$, the putative second gain for the current time frame is $g_1(k,n)$, the second gain for a (immediately) preceding time frame is $g_{l1}(k,n-1)$, the first gain for a current time frame is $g_{l0}(k,n)$, the putative first gain for the current time frame $g_0(k,n)$ and the first gain for a (immediately) preceding time frame is $g_{l0}(k,n-1)$.

The gains are thus smoothed over time. As the louder channel may change over time, the signal may be moved from either channel.

In some but not necessarily all examples, the smoothing is adaptive.

For example, weighting of the weighted summation is adaptable in dependence upon a putative impact of the putative second gain for the current time frame on the level difference 7 between the processed left channel and the processed right channel.

For example, the coefficients a and b can depend upon the second gain and the movement of energy between channels.

If the gain $g_0(k,n)$ that determines how much energy is being moved from the louder to the softer channel is increasing over time then the more recent greater gain is weighted more (a/b is greater), for example the more recent gain is as favored or more favored than previous gains. For example, if $E'_0(k,n)<E'_1(k,n)$, then a/b is greater when $g_0(k,n)>g_{r0}(k,n-1)$ than when $g_0(k,n)<g_{r0}(k,n-1)$.

The weighting of the weighted summation can be biased to decrease the level difference between the processed left channel and the processed right channel more quickly than increase the level difference between the processed left channel and the processed right channel.

If the putative second gain for the current time frame will reduce the level difference $|E'_0(k,n)-E'_1(k,n)|$, between the left channel and the right channel, then it is more heavily weighted in the summation. If the putative second gain for the current time frame will increase the level difference between the left channel and the right channel, then it is less heavily weighted in the summation.

Thus smoothing can for example be asymmetric. Changes in movement of energy over time (e.g. controlled by selection of values of a and b) is more responsive for changes that cause a decrease in the level difference between the processed left channel and the processed right channel than changes that cause an increase in the level difference between the processed left channel and the processed right channel.

The processing is done based which one of the channels is louder. If $E'_0(k,n)<E'_1(k,n)$, the processing is, for example, performed as follows if $g_0(k,n)>g_{r0}(k,n-1)$ $$g_{r0}(k,n)=a_2g_0(k,n)+b_2g_{r0}(k,n-1)$$

$$g_{r1}(k,n)=a_2g_1(k,n)+b_2g_{r1}(k,n-1)$$

else $$g_{r0}(k,n)=a_3g_0(k,n)+b_3g_{r0}(k,n-1)$$

$$g_{r1}(k,n)=a_3g_1(k,n)+b_3g_{r1}(k,n-1)$$

and $$g_{l0}(k,n)=b_3g_{l0}(k,n-1)$$

$$g_{l1}(k,n)=a_3+b_3g_{l1}(k,n-1)$$

where $a_2$, $b_2$, $a_3$, and $b_3$ are smoothing coefficients (e.g., $a_2=0.5$, $b_2=1-a_2$, $a_3=0.01$, and $b_3=1-a_3$). The difference between $a_2$ & $a_3$ indicates different weighting of more recent gain. The difference between $b_3$ & $b_2$ indicates different weighting of older gain. The difference between $a_2$ & $b_2$ compared to the difference between $a_3$ & $b_3$ makes movement of energy greater if the movement causes a decrease in the level difference.

Correspondingly, if $E'_0(k,n)>E'_1(k,n)$, the processing is performed as follows if $g_0(k,n)>g_{l0}(k,n-1)$ $$g_{l0}(k,n)=a_2g_0(k,n)+b_2g_{l0}(k,n-1)$$

$$g_{l1}(k,n)=a_2g_1(k,n)+b_2g_{l1}(k,n-1)$$

else $$g_{l0}(k,n)=a_3g_0(k,n)+b_3g_{l0}(k,n-1)$$

$$g_{l1}(k,n)=a_3g_1(k,n)+b_3g_{l1}(k,n-1)$$

and $$g_{r0}(k,n)=b_3g_{r0}(k,n-1)$$

$$g_{r1}(k,n)=a_3+b_3g_{r1}(k,n-1)$$

where $a_2$, $b_2$, $a_3$, and $b_3$ are the same smoothing coefficients (e.g., $a_2=0.5$, $b_2=1-a_2$, $a_3=0.01$, and $b_3=1-a_3$).

A mixer 72 is controlled by the mixing gains provided by block 70 which are dependent upon the mixing mode.

In the "mix" mode some energy is moved from the louder channel to the softer channel. This creates a processed left channel and a processed right channel of a processed stereo audio signal 5. If the level difference 7 is above the threshold 9 for a frequency band, the apparatus 10 moves signal energy for that frequency band (but not necessarily other frequency bands) from a louder one of the left channel and the right channel to the other of the left channel and the right channel to create a processed left channel and a processed right channel of a processed stereo audio signal.

$$S'_0(k,n)=g_{l1}(k,n)S_0(k,n)+g_{r0}(k,n)S_1(k,n)$$

$$S'_1(k,n)=g_{r1}(k,n)S_1(k,n)+g_{l0}(k,n)S_0(k,n)$$

If it is determined to use the passthrough mode then the stage of moving energy from the louder channel to the softer channel is bypassed. If the level difference 7 is not above the threshold for a frequency band, the apparatus 10 bypasses moving signal energy for that frequency band (but not necessarily other frequency bands) from a louder one of the left channel and the right channel to the other of the left channel and the right channel to create a processed left channel and a processed right channel of a processed stereo audio signal.

$$S'_0=S_0$$

$$S'_1=S_1$$

In the mix mode, the mixing gains $g_{l1}(k,n)$, $g_{r0}(k,n)$, $g_{r1}(k,n)$, $g_{l0}(k,n)$ have been computed in frequency bands k, and they need to be transformed to values for each frequency bin b. This can, e.g., be performed by simply setting the value for the frequency band to each frequency bin inside the frequency band. Using these values, the input signal can be processed $$S'_0(b,n)=g_{l1}(b,n)S_0(b,n)+g_{r0}(b,n)S_1(b,n)$$

$$S'_1(b,n)=g_{r1}(b,n)S_1(b,n)+g_{l0}(b,n)S_0(b,n)$$

The resulting signals $S'_0(b,n)$ and $S'_1(b,n)$ are transformed back to time domain at block 74. This transform should be the inverse of the transform that was applied at block 60. The resulting signals $s'_i(t)$ 5 are the output of the processing.

The output may also be unmodified input signal 3 if the level difference 7 is not above the threshold in any frequency band.

The processing described can occur in real time. The apparatus 10 is a real-time audio processing apparatus. The processing described can be performed during playback. In other examples, some or all of the processing described can be performed before playback.

The descriptions above have described processing in the frequency domain. This is optional. The processing can occur in the time domain only. This processing can be understood in the limit of a single (large) frequency bin in a single (large) frequency band.

Figure 5:
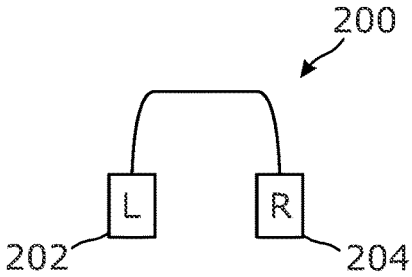
FIG. 5 shows another example embodiment of the subject matter described herein.

FIG. 5 illustrates an example of headphones 200 comprising a left-ear audio output device 202 and a right-ear audio output device 204. The processed left channel is rendered from the left-ear audio output device 202 and the processed right channel is rendered from the right-ear audio output device 204.

In some examples, the headphones 200 are the apparatus 10 and receive the audio signal 3.

In some examples, the headphones 200 are coupled to the apparatus 10 and receive from the apparatus 10 the audio signals 3,5.

In some examples, the left audio output device 202 is a left headphone for positioning at or in a user's left ear and the right audio output device 204 is a right headphone for positioning at or in a user's right ear. In some examples, the left and right headphones are provided as in-ear buds. In some examples, the left and right headphones are positioned at a user's ears by a supporting headset.

If the input stereo signal 3 comprises a sound source that is hard-panned (i.e., positioned to only left or right) or extreme-panned (i.e., positioned predominantly to left or right) then it can be reproduced satisfactorily using stereo loudspeakers. However, if that kind of stereo signal is reproduced with headphones, it produces an unnatural perception. In headphone reproduction, the left audio signal is reproduced by the left headphone, and, as a result, it reaches only (or predominantly) the left ear and the right audio signal reaches only the right ear. Hard-panned or extreme-panned audio sources in stereo content, when reproduced by headphones cause inter-aural level differences (ILD) that are very high. Furthermore, the ILDs are very high at all frequencies.

For a natural sound source, ILDs are very small at low frequencies (regardless of the sound source direction) and increase when the frequency is increased (for sound sources on the sides). This is due to frequency-dependent shadowing of the human head. At lower frequencies, the head does not significantly shadow the audio. Thus headphone reproduction of hard-panned or extreme-panned sound sources causes very large ILDs, which causes unnatural ILDs. In practice, this is perceived as unpleasant and unnatural playback. This may be characterized as a "feeling of pressure", or even as slight pain.

The apparatus 10 can be used to address this problem and provide improved headphone playback.

The stereo signals are modified when they would not be pleasant to listen to with headphones, and not otherwise. The stereo image is kept unmodified (preserving the spatial impression), unless modifications are needed (in which case spatiality is still maintained but extreme panning effects are softened for enhanced listening comfort).

The apparatus 10 can also be used with loudspeaker playback. The processing can be performed as for the headphone playback, but the output stereo signals are forwarded to loudspeakers instead of headphones (the processing may also be different in alternative embodiments). In the case of loudspeaker playback, the apparatus can be used to get more natural stereo mixing instead of extreme, hard-panned mixing.

A use case will now be described. The original signal 3 (e.g. "Wild Life" by "Wings"). has level differences 7 between the channels of the stereo signals computed using 10 ms frames. There is prominent level difference 7 at certain time instants (especially between 10 and 20 seconds, due to hard-panned keyboards in the right channel). This creates an unpleasant listening experience when listening with headphones. The modified signal 5 has different level differences 7. The largest level differences (between 10 and 20 seconds) will have been made smaller. As a result, the listening experience is made significantly more comfortable for headphone listening. When there are no excess level differences 7 in the original signal, the signal 5 is not modified and is the same or substantially the same as the original signal.

Figure 6A:
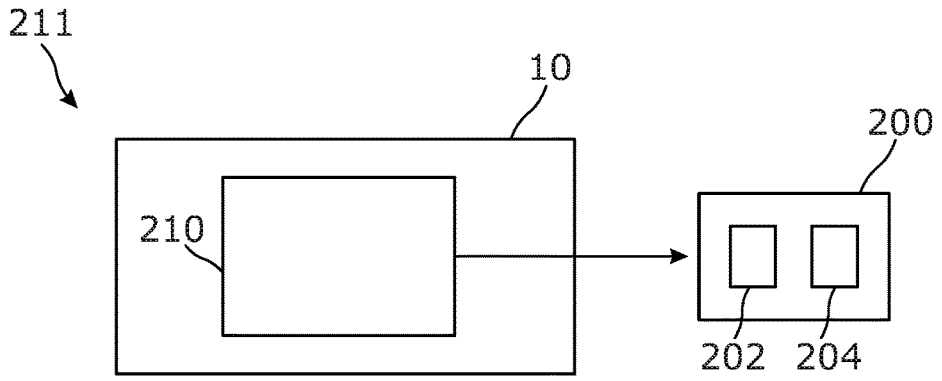
FIG. 6A shows another example embodiment of the subject matter described herein.
Figure 6B:
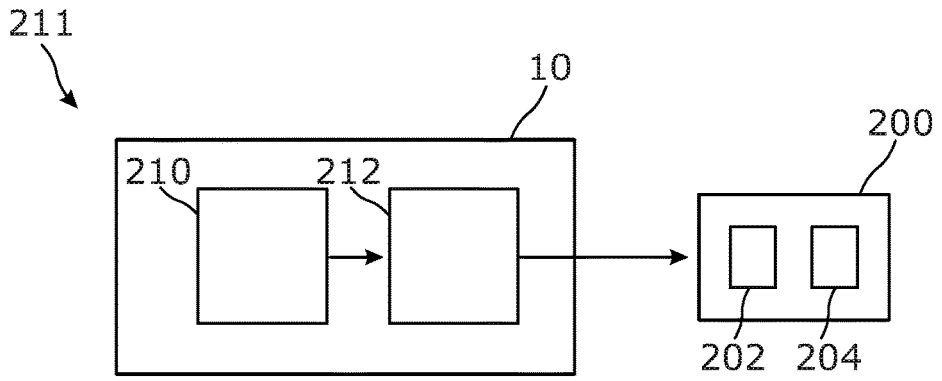
FIG. 6B shows another example embodiment of the subject matter described herein.

FIGS. 6A and 6B illustrate examples of a system 211 comprising an apparatus 10 as previously described, and an audio rendering apparatus 200, for example headphones 200 comprising a left-ear audio output device 202 for rendering the processed left channel and a right-ear audio output device 204 for rendering the processed right channel.

In this example a bitstream is retrieved from storage, or it may be received via network. The bitstream can be fed to a decoder, if the audio signals have been compressed, to decode the audio signals. The resulting stereo audio signals 3 are fed to excess panning remover 210 that comprises analysis means 20, determining means 30 and modifying means 40. The excess panning remover 210 performs the method 100, an example of which have been described with reference to FIG. 3 and FIG. 4. The excess panning remover 210 is provided by software running inside a computer or computing device (e.g. a mobile phone, a personal audio device).

In the example of FIG. 6A, the excess panning remover 210 is provided by code running inside player software. The manufacturer of the player software thus provides improved user experience for headphone listening.

In the example of FIG. 6B, the excess panning remover 210 is provided by code running outside player software 212 in a plug-in. The manufacturer of the apparatus 10 or the headphones 200 can provide the plug-in to provide improved user experience for headphone listening. The plugin could be implemented as stand-alone software by a third party.

Figure 7:
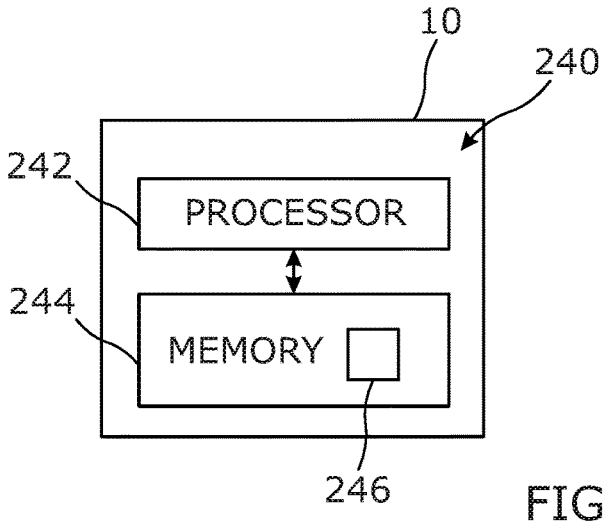
FIG. 7 shows another example embodiment of the subject matter described herein.

FIG. 7 illustrates an example of a controller 240. Implementation of a controller 240 may be as controller circuitry. The controller 240 may be implemented in hardware alone, have certain aspects in software including firmware alone or can be a combination of hardware and software (including firmware).

As illustrated in FIG. 7 the controller 240 may be implemented using instructions that enable hardware functionality, for example, by using executable instructions of a computer program 246 in a general-purpose or special-purpose processor 242 that may be stored on a computer readable storage medium (disk, memory etc) to be executed by such a processor 242.

The processor 242 is configured to read from and write to the memory 244. The processor 242 may also comprise an output interface via which data and/or commands are output by the processor 242 and an input interface via which data and/or commands are input to the processor 242.

The memory 244 stores a computer program 246 comprising computer program instructions (computer program code) that controls the operation of the apparatus 10 when loaded into the processor 242. The computer program instructions, of the computer program 246, provide the logic and routines that enables the apparatus to perform the methods illustrated in FIG. 1, 2 or 3. The processor 242 by reading the memory 244 is able to load and execute the computer program 246.

The apparatus 10 therefore comprises:

at least one processor 242; and at least one memory 244 including computer program code the at least one memory 244 and the computer program code configured to, with the at least one processor 242, cause the apparatus 10 at least to perform:

(i) analyzing 120 level differences 7 between a left channel and a right channel of a stereo audio signal 3;

(ii) determining 130 if a level difference 7 between the left channel and the right channel is above a threshold 9;

(iii) conditionally, if the level difference 7 is above the threshold 9, moving 140 signal energy from a louder one of the left channel and the right channel to the other of the left channel and the right channel to create a processed left channel and a processed right channel of a processed stereo audio signal 5.

Figure 8:
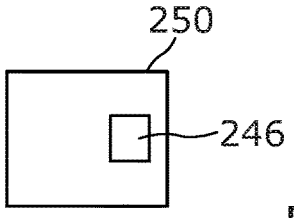
FIG. 8 shows another example embodiment of the subject matter described herein.

As illustrated in FIG. 8, the computer program 246 may arrive at the apparatus 10 via any suitable delivery mechanism 250. The delivery mechanism 250 may be, for example, a machine readable medium, a computer-readable medium, a non-transitory computer-readable storage medium, a computer program product, a memory device, a record medium such as a Compact Disc Read-Only Memory (CD-ROM) or a Digital Versatile Disc (DVD) or a solid state memory, an article of manufacture that comprises or tangibly embodies the computer program 246. The delivery mechanism may be a signal configured to reliably transfer the computer program 246. The apparatus 10 may propagate or transmit the computer program 246 as a computer data signal.

Computer program instructions for causing an apparatus to perform at least the following or for performing at least the following:

(i) analyzing 120 level differences 7 between a left channel and a right channel of a stereo audio signal 3;

(ii) determining 130 if a level difference 7 between the left channel and the right channel is above a threshold 9;

(iii) conditionally, if the level difference 7 is above the threshold 9, moving 140 signal energy from a louder one of the left channel and the right channel to the other of the left channel and the right channel to create a processed left channel and a processed right channel of a processed stereo audio signal 5.

The computer program instructions may be comprised in a computer program, a non-transitory computer readable medium, a computer program product, a machine readable medium. In some but not necessarily all examples, the computer program instructions may be distributed over more than one computer program.

Although the memory 244 is illustrated as a single component/circuitry it may be implemented as one or more separate components/circuitry some or all of which may be integrated/removable and/or may provide permanent/semi-permanent/dynamic/cached storage.

Although the processor 242 is illustrated as a single component/circuitry it may be implemented as one or more separate components/circuitry some or all of which may be integrated/removable. The processor 242 may be a single core or multi-core processor.

References to 'computer-readable storage medium', 'computer program product', 'tangibly embodied computer program' etc. or a 'controller', 'computer', 'processor' etc. should be understood to encompass not only computers having different architectures such as single/multi-processor architectures and sequential (Von Neumann)/parallel architectures but also specialized circuits such as field-programmable gate arrays (FPGA), application specific circuits (ASIC), signal processing devices and other processing circuitry. References to computer program, instructions, code etc. should be understood to encompass software for a programmable processor or firmware such as, for example, the programmable content of a hardware device whether instructions for a processor, or configuration settings for a fixed-function device, gate array or programmable logic device etc.

As used in this application, the term 'circuitry' may refer to one or more or all of the following:

(a) hardware-only circuitry implementations (such as implementations in only analog and/or digital circuitry) and (b) combinations of hardware circuits and software, such as (as applicable):

(i) a combination of analog and/or digital hardware circuit(s) with software/firmware and (ii) any portions of hardware processor(s) with software (including digital signal processor(s)), software, and memory(ies) that work together to cause an apparatus, such as a mobile phone or server, to perform various functions and (c) hardware circuit(s) and or processor(s), such as a microprocessor(s) or a portion of a microprocessor(s), that requires software (e.g. firmware) for operation, but the software may not be present when it is not needed for operation.

This definition of circuitry applies to all uses of this term in this application, including in any claims. As a further example, as used in this application, the term circuitry also covers an implementation of merely a hardware circuit or processor and its (or their) accompanying software and/or firmware. The term circuitry also covers, for example and if applicable to the particular claim element, a baseband integrated circuit for a mobile device or a similar integrated circuit in a server, a cellular network device, or other computing or network device.

The blocks illustrated in the FIG. 1, 2 or 3 may represent steps in a method and/or sections of code in the computer program 246. The illustration of a particular order to the blocks does not necessarily imply that there is a required or preferred order for the blocks and the order and arrangement of the block may be varied. Furthermore, it may be possible for some blocks to be omitted.

Blocks or components that are described or illustrated as connected can, in at least some examples, be operationally coupled. Operationally coupled means any number or combination of intervening elements can exist (including no intervening elements).

Where a structural feature has been described, it may be replaced by means for performing one or more of the functions of the structural feature whether that function or those functions are explicitly or implicitly described.

As used here 'module' refers to a unit or apparatus that excludes certain parts/components that would be added by an end manufacturer or a user. The apparatus 100 can be a module. The computer program 246 can be a module.

The audio signal 5 can be transmitted as an electromagnetic signal encoding information.

The audio signal 5 can be stored as an addressable data structure encoding information.

The signal 5 is a signal with embedded data, the signal being encoded in accordance with an encoding process which comprises:

(i) analyzing 120 level differences 7 between a left channel and a right channel of a stereo audio signal 3;

(ii) determining 130 if a level difference 7 between the left channel and the right channel is above a threshold 9;

(iii) conditionally, if the level difference 7 is above the threshold 9, moving 140 signal energy from a louder one of the left channel and the right channel to the other of the left channel and the right channel to create a processed left channel and a processed right channel of a processed stereo audio signal 5.

The above described examples find application as enabling components of: automotive systems; telecommunication systems; electronic systems including consumer electronic products; distributed computing systems; media systems for generating or rendering media content including audio, visual and audio visual content and mixed, mediated, virtual and/or augmented reality; personal systems including personal health systems or personal fitness systems; navigation systems; user interfaces also known as human machine interfaces; networks including cellular, non-cellular, and optical networks; ad-hoc networks; the internet; the internet of things; virtualized networks; and related software and services.

The term 'comprise' is used in this document with an inclusive not an exclusive meaning. That is any reference to X comprising Y indicates that X may comprise only one Y or may comprise more than one Y. If it is intended to use 'comprise' with an exclusive meaning then it will be made clear in the context by referring to "comprising only one . . . " or by using "consisting".

In this description, reference has been made to various examples. The description of features or functions in relation to an example indicates that those features or functions are present in that example. The use of the term 'example' or 'for example' or 'can' or 'may' in the text denotes, whether explicitly stated or not, that such features or functions are present in at least the described example, whether described as an example or not, and that they can be, but are not necessarily, present in some of or all other examples. Thus 'example', 'for example', 'can' or 'may' refers to a particular instance in a class of examples. A property of the instance can be a property of only that instance or a property of the class or a property of a sub-class of the class that includes some but not all of the instances in the class. It is therefore implicitly disclosed that a feature described with reference to one example but not with reference to another example, can where possible be used in that other example as part of a working combination but does not necessarily have to be used in that other example.

Although embodiments have been described in the preceding paragraphs with reference to various examples, it should be appreciated that modifications to the examples given can be made without departing from the scope of the claims.

Features described in the preceding description may be used in combinations other than the combinations explicitly described above.

Although functions have been described with reference to certain features, those functions may be performable by other features whether described or not.

Although features have been described with reference to certain embodiments, those features may also be present in other embodiments whether described or not.

The term 'a' or 'the' is used in this document with an inclusive not an exclusive meaning. That is any reference to X comprising a/the Y indicates that X may comprise only one Y or may comprise more than one Y unless the context clearly indicates the contrary. If it is intended to use 'a' or 'the' with an exclusive meaning then it will be made clear in the context. In some circumstances the use of 'at least one' or 'one or more' may be used to emphasis an inclusive meaning but the absence of these terms should not be taken to infer and exclusive meaning.

The presence of a feature (or combination of features) in a claim is a reference to that feature or (combination of features) itself and also to features that achieve substantially the same technical effect (equivalent features). The equivalent features include, for example, features that are variants and achieve substantially the same result in substantially the same way. The equivalent features include, for example, features that perform substantially the same function, in substantially the same way to achieve substantially the same result.

In this description, reference has been made to various examples using adjectives or adjectival phrases to describe characteristics of the examples. Such a description of a characteristic in relation to an example indicates that the characteristic is present in some examples exactly as described and is present in other examples substantially as described.

Whilst endeavoring in the foregoing specification to draw attention to those features believed to be of importance it should be understood that the Applicant may seek protection via the claims in respect of any patentable feature or combination of features hereinbefore referred to and/or shown in the drawings whether or not emphasis has been placed thereon.

That which is claimed:

1. An apparatus comprises: at least one processor; and at least one memory including computer program code, the at least one memory and the computer program code configured to, with the at least one processor, cause the apparatus at least to:

analyze a level difference between a left channel and a right channel of a stereo audio signal;

determine if the level difference between the left channel and the right channel is above a threshold; and conditionally, if the determined level difference is above the threshold, move signal energy from a louder one of the left channel and the right channel to the other of the left channel and the right channel to create a processed stereo audio signal.

2. An apparatus as claimed in claim 1, wherein the apparatus is further caused to smooth the level difference over time before being caused to determine if the level difference between the left channel and the right channel is above the threshold.

3. An apparatus as claimed in claim 1, wherein the apparatus is caused to:

conditionally, if the level difference is above the threshold for at least one frequency band of a plurality of frequency bands, move signal energy for that at least one frequency band from the louder one of the left channel and the right channel to the other of the left channel and the right channel to create the processed stereo audio signal.

4. An apparatus as claimed in claim 1, wherein the apparatus is further caused to smooth over time movement of signal energy from the louder one of the left channel and the right channel to the other of the left channel and the right channel.

5. An apparatus as claimed in claim 1, wherein the apparatus is further caused to re-scale a signal energy level of the louder one of the left channel and the right channel after moving signal energy from the louder one of the left channel and the right channel to the other of the left channel and the right channel.

6. An apparatus as claimed in claim 1, wherein a first gain is used to re-scale a signal energy level of the louder one of the left channel and the right channel after moving signal energy from the louder one of the left channel and the right channel to the other of the left channel and the right channel and a second gain is used to define the signal energy moved from the louder one of the left channel and the right channel to the other of the left channel and the right channel, wherein the second gain used for a current time frame is based on a weighted summation of a putative second gain for the current time frame and at least the second gain used for a preceding time frame, and wherein weightings of the summation are adaptable in dependence upon a putative impact of the putative second gain for the current time frame on the level difference between the left channel and the right channel of the processed stereo audio signal.

7. An apparatus as claimed in claim 6, wherein the weightings of the summation are biased to decrease the level difference between the left channel and the right channel of the processed stereo audio signal more quickly than to increase the level difference between the left channel and the right channel of the processed stereo audio signal.

8. An apparatus as claimed in claim 1, wherein the apparatus is caused to control movement of signal energy from the louder one of the left channel and the right channel to the other of the left channel and the right channel in dependence upon the determined level difference, wherein when the determined level difference is above the threshold, then a target level difference is less than the determined level difference, wherein the controlled movement of signal energy is adaptable by a user and/or wherein the target level difference has a maximum value at least when the determined level difference exceeds a saturation value.

9. An apparatus as claimed in claim 1, wherein the apparatus is caused to at least one of:

conditionally, if the level difference is not above the threshold, not to move signal energy from the louder one of the left channel and the right channel to the other of the left channel and the right channel to create the processed stereo audio signal; and conditionally, if the level difference is not above the threshold for a frequency band, bypass movement of signal energy for that frequency band from the louder one of the left channel and the right channel to the other of the left channel and the right channel to create the processed stereo audio signal.

10. An apparatus as claimed in claim 1, wherein the apparatus is configured as headphones comprising a left-ear audio output device and a right-ear audio output device and is further configured to render the left channel of the processed stereo audio signal from the left-ear audio output device and the right channel of the processed stereo audio signal from the right-ear audio output device.

11. An apparatus as claimed in claim 1, wherein the apparatus is further caused to render the processed stereo audio signal from a headphone, and wherein the headphone comprises a left-ear audio output device for rendering the left channel of the processed stereo audio signal and a right-ear audio output device for rendering the right channel of the processed stereo audio signal.

12. An apparatus as claimed in claim 11, is one of:

the headphone, wherein the stereo audio signal is received at the headphone; or coupled to the headphone, wherein the apparatus is caused to provide the stereo audio signal to the headphone.

13. An apparatus as claimed in claim 1, wherein the apparatus further comprises an application for user selection of audio for playback.

14. A method comprising:

analyzing a level difference between a left channel and a right channel of a stereo audio signal;

determining if the level difference between the left channel and the right channel is above a threshold; and conditionally, if the determined level difference is above the threshold, moving signal energy from a louder one of the left channel and the right channel to the other of the left channel and the right channel to create a processed stereo audio signal.

15. A method as claimed in claim 14, further comprising smoothing the level difference over time before determining if the level difference between the left channel and the right channel is above the threshold.

16. A method as claimed in claim 14, further comprising conditionally, if the level difference is above the threshold for at least one frequency band of a plurality of frequency bands, moving signal energy for that at least one frequency band from the louder one of the left channel and the right channel to the other of the left channel and the right channel to create the processed stereo audio signal.

17. A method as claimed in claim 14, further comprising at least one of:

smoothing over time movement of signal energy from the louder one of the left channel and the right channel to the other of the left channel and the right channel; or re-scaling a signal energy level of the louder one of the left channel and the right channel after moving signal energy from the louder one of the left channel and the right channel to the other of the left channel and the right channel.

18. A method as claimed in claim 14, wherein a first gain is used to re-scale a signal energy level of the louder one of the left channel and the right channel after moving signal energy from the louder one of the left channel and the right channel to the other of the left channel and the right channel and a second gain is used to define the signal energy moved from the louder one of the left channel and the right channel to the other of the left channel and the right channel, wherein the second gain used for a current time frame is based on a weighted summation of a putative second gain for the current time frame and at least the second gain use for a preceding time frame, and wherein weightings of the summation are adaptable in dependence upon a putative impact of the putative second gain for the current time frame on the level difference between the left channel and the right channel of the processed stereo audio signal.

19. A method as claimed in claim 18, wherein the weightings of the summation are biased to decrease the level difference between the left channel and the right channel of the processed stereo audio signal more quickly than increase the level difference between the left channel and the right channel of the processed stereo audio signal.

20. A method as claimed in claim 14, further comprising at least one of:

conditionally, if the level difference is not above the threshold, not moving signal energy from the louder one of the left channel and the right channel to the other of the left channel and the right channel to create the processed stereo audio signal; or conditionally, if the level difference is not above the threshold for a frequency band, bypassing movement of signal energy for that frequency band from the louder one of the left channel and the right channel to the other of the left channel and the right channel to create the processed stereo audio signal.

* * * * *